United States Patent [19]

Piatkowski

[11] Patent Number: 4,602,963

[45] Date of Patent: Jul. 29, 1986

[54] METHOD FOR METAL CLEANING

[75] Inventor: Tadeusz L. Piatkowski, Troy, Mich.

[73] Assignee: Surface Treatments, Inc., Warren, Mich.

[21] Appl. No.: 689,391

[22] Filed: Jan. 7, 1985

[51] Int. Cl.[4] ..... C23G 1/00

[52] U.S. Cl. ..... 134/2; 134/10; 134/18; 134/39; 134/40; 356/436; 436/166

[58] Field of Search ..... 134/2, 10, 18, 39, 40; 210/704, 705, 708; 436/55, 164, 166, 178; 356/36, 436

[56] References Cited

U.S. PATENT DOCUMENTS

| | | | |
|---|---|---|---|
| 2,042,347 | 5/1936 | Mackenzie | 436/55 X |
| 2,047,989 | 7/1936 | Woeflin | 210/704 X |
| 2,759,607 | 8/1956 | Boyd et al. | 210/704 |
| 3,247,176 | 4/1966 | Veal | 436/55 X |
| 4,261,812 | 4/1981 | Newcombe | 210/708 X |
| 4,477,286 | 10/1984 | Rossmann et al. | 210/708 X |

*Primary Examiner*—Arthur L. Corbin

*Attorney, Agent, or Firm*—Brooks & Kushman

[57] ABSTRACT

Described is an improved process for effectively cleaning metal surfaces. This method includes applying to the metal a bath liquid having at least one surfactant and at least one alkaline salt, periodically monitoring the concentration of the surfactant in the bath liquid, and adding additional surfactant to the bath liquid as needed to provide the necessary concentration while maintaining the concentration of the alkaline salt constant. The periodic monitoring is performed by an extraction test, where the extracted sample is then subjected to a light absorbance test. Once the concentration has been determined, sufficient surfactant is added to the bath liquid to restore the concentration to its optimum level. Also described is a method for complexing the oil which has been removed from the metal with an additional surfactant additive to form a complex compound which has a density less than that of the bath liquid. The oil-surfactant compound rises to the top of the bath and may be skimmed off.

20 Claims, No Drawings

METHOD FOR METAL CLEANING

TECHNICAL FIELD

This invention relates to metal cleaning and a process for monitoring and adjusting the concentration of the chemical cleaning components to provide optimal results.

BACKGROUND ART

Metal cleaning technology has remained relatively unchanged for many years. Recent improvements in the cleaning technology include additional cleaning tanks, increased pressure and higher operating temperatures. The majority of the improvements have been mechanical in nature as opposed to chemical.

Environmental concerns have led the industry to seek metal cleaning methods which produce less waste. Traditional cleaning and degreasing methods produce alkaline waste which poses an environmental hazard. The volume of the alkaline waste is great enough to warrant concern, since millions of dollars have to be spent each year in disposing of the waste. Waste in massive quantities is inherent in the way the cleaning chemicals are conventionally sold.

Metal cleaning chemicals are conventionally sold in one package to be added to water to provide a cleaning solution that removes protective oils, carbonaceous matter, alkaline salts and other residues from metal surfaces. The one package metal cleaner is pre-blended in the required ratio to provide best results for the particular cleaning to be performed. Two basic problems result.

First, the chemical components which are consumed at a faster rate than the others determine the lifetime of the cleaning solution. This increases waste because a portion of the solution in the tank must be drained before fresh chemicals are added. Such waste is an environmental hazard and disposing of it is a costly procedure. It has been shown that when the soil concentration raises above 1%, the cleaning ability of the cleaning solution deteriorates dramatically.

Second, it is difficult to optimize metal cleaning operations for specific residue encountered on individual metal surfaces from different suppliers. The problem arises because the ratio of chemical components in conventional cleaners is fixed and cannot be changed when cleaning metals from different suppliers. One cleaning composition simply cannot work efficiently for all metal cleaning as the coatings are different from one supplier to the next.

DISCLOSURE OF THE INVENTION

An object of the present invention is to provide an improved process for effectively cleaning metal surfaces. In carrying out this object, one use for which the invention has particular utility is in chemically cleaning coated metal coils. Members of the coil coating industry ship metal coils having various protective oils, carbonaceous matter, alkaline salts and other residues on their surfaces. In order to optimize the metal cleaning operation, a base and one or more additives are combined such that the resultant composition may be readily adapted to the particular cleaning operation. The process of the present invention substantially reduces costs, adds flexibility to complicated cleaning operations, and dramatically reduces the environmental control costs of the metal cleaning operation.

Reduction of costs is achieved because the chemical components which are used up more quickly than others may be added individually, eliminating the need for draining the entire tank and starting with fresh pre-blended chemicals. Flexibility is achieved with complicated cleaning operations because the most effective components may be selected and combined for particular cleaning operations. Dramatic environmental control cost reduction is accomplished by providing a method which produces minimal waste of any component that presents an environmental hazard. One of the environmentally hazardous components in metal cleaning solutions is the alkaline salt, which is consumed at a much slower rate than the surfactant. Another is the oil which ends up in the cleaning solution. The present invention discloses a system in which the alkaline salt of the cleaning solution is retained for a much longer period of time than with conventional methods.

A method for metal cleaning and degreasing incorporating the invention includes the steps of applying to the metal a bath liquid including at least one surfactant and at least one alkaline salt, periodically monitoring the concentration of the surfactant in the bath liquid, and adding additional surfactant to the bath liquid as needed to provide the necessary concentration while maintaining the concentration of the alkaline salt constant. The periodic monitoring is accomplished by removing an aliquot of the bath liquid, adding an extracting reagent to the aliquot to form a separate layer of surfactant and then testing the surfactant layer by a light absorbance test to determine its concentration. Preferably, the extracting reagents are chlorinated solvents, particularly methylene chloride. Cobalt thiocyanate is added to the surfactant layer to sensitize it to the light absorbance test. The light absorbance test is preferably performed in the range of from about 500 to about 900 nanometers and, most preferably, at about 650 nanometers to measure the absorbance of the surfactant.

The concentrations of the surfactant and the alkaline salts must be maintained at constant predetermined values for optimal cleaning. The process of the present invention maintains these concentrations generally constant throughout prolonged cleaning while nevertheless producing minimal hazardous waste.

In carrying out the process, the desirable surfactant concentration is from about 0.01 to about 0.5 percentage by weight. The preferable alkaline salt concentration is from about 0.1 to about 5 percentage by weight. The optimal concentration of the surfactant is maintained by monitoring its concentration and then adding any additional surfactant needed.

Two different surfactants are used in the process. A first surfactant (or combination of surfactants) is used to remove oils and residue on the metal surface. A second surfactant is added to raise oil residue to the surface of the bath to be skimmed off. An HLB ratio is used to describe the ratio of hydrophilic to lipophilic balance and describes the affinity for complexing between polar and non-polar compounds in emulsion systems. The residue removing surfactant has an HLB ratio with a value of 4 or more greater than the HLB ratio of the second surfactant which is added to raise the oil to the surface of the bath. The second surfactant is introduced into the bath liquid to complex with oil residue which has been cleaned off the metal. The surfactant additive and oil residue form a complex compound which has a density less than that of the bath liquid and floats to the surface. This complex compound may then be skimmed from the top surface of the bath liquid. Preferably, a non-ionic surfactant is used to complex with the oil residue.

In one preferred method, a bath liquid including a surfactant that removes residue is applied to the metal and additional surfactant is added to the bath liquid to produce effective cleaning in accordance with test results provided by periodically monitoring the concentration of the surfactant in the bath liquid. The periodic monitoring includes removing an aliquot of the bath liquid, adding an extracting reagent to the aliquot to form a separate layer of surfactant, and testing the surfactant layer of the aliquot with a light absorbance test to determine the surfactant concentration. Once again, a chlorinated solvent such as methylene chloride is preferably used as the extracting reagent to separate the surfactant from the rest of the aliquot. Cobalt thiocyanate is added to the surfactant layer to provide sensitivity to the light absorbance test used to determine the surfactant concentration. The absorbance of the cobalt thiocyanate-surfactant complex as previously mentioned is preferably measured in the range from about 500 to 900 nanometers and, most preferably at about 650 nanometers.

One preferred way of performing the method involves applying a surfactant having an HLB ratio of 12 or more to the metal for removing oil residue on the metal, periodically monitoring the surfactant concentration of the bath liquid, adding more surfactant to the bath liquid and thereafter introducing at least one additional surfactant additive having an HLB ratio of 4 or less into the liquid bath. The additional surfactant additive having an HLB ratio of 4 or less will complex with oil residue which has been removed from the metal. A complex compound is thereby formed with a density less than that of the bath liquid so as to float to the surface of the bath. Preferably, a non-ionic surfactant is used to complex with the oil residue.

The objects, features, and advantages of the present invention are readily apparent from the following detailed description of the best mode for carrying out the invention.

BEST MODE FOR CARRYING OUT THE INVENTION

The process of the present invention is useful for cleaning most metallic substrates used in the industry, such as iron, zinc, aluminum, stainless steel, brass, copper and the like. The cleaner components are designed to remove a wide variety of protective soaps and oils put on the metal during manufacturing. Examples of oils found on metal surfaces include paraffinic oils, sulfurized oils, chlorinated sulfonated oils and the like. Other residues and carbonaceous matters found on metal surfaces are those which are well known in the industry.

The level of performance of the metal cleaning solution is maintained due to three factors. First, a salt base cleaner has various surfactant additives which are particularly useful in cleaning individual oils, smut, soaps, or other residues found on the metal surfaces. The second factor is monitoring of the surfactant concentration in the cleaning solution. The third factor is the adjustment of the surfactant concentration to duplicate the optimal level of surfactant in the cleaning solution for the particular cleaning job.

The base cleaner is an alkaline powder cleaner containing sodium tripolyphosphates and sodium hydroxide. The surfactants may include Igepal C0630, Antarox LF 344, Pluronic L61, Siponic 260, and the like. These surfactants are generally organic additives designed to improve cleaning of oily cold rolled steel or treating smutty steel.

The surfactants may be added individually to the cleaning solution to maintain its effectiveness. After the cleaning solution has been used for sometime to clean the metal, its effectiveness will decrease as the surfactant is consumed. At this time, an additional surfactant additive having an HLB ratio of 4 or less is introduced into the liquid bath to complex with the oil residue which has been removed from the metal. A complex compound is formed between the additive and the oil residue which has a density less than that of the bath liquid. This complex compound floats to the surface of the bath liquid and may be skimmed from the top. The solution may then be tested to determine which components must be added to raise the various chemical concentrations to their optimum levels. The surfactant concentration is monitored by a test involving removing an aliquot of the bath liquid. This aliquot is separated into surfactant layer and an alkaline layer by the addition of an extracting reagent that is preferably methylene chloride. The surfactant layer is then sensitized with cobalt thiocyanate and subjected to a light absorbance test preferably performed in the range of about 500 to 900 nanometers and, most preferably, about 650 nanometers. The absorbance of the light indicates the surfactant concentration. From this data, calculations can be made to determine the amount of surfactant necessary to bring the cleaning solution back up to a optimum level.

Having now described the invention in general, recited below is an example where all the cited percentages are by weight. In the example, a cold rolled steel metallic substrate was sprayed with the cleaner composition for about 10 seconds.

EXAMPLE I

An alkaline powder metal cleaner was formulated as follows:

| | |
|---|---|
| 40% | Sodium tripolyphosphate |
| 40% | Sodium hydroxide |
| 2% | Sodium gluconate |
| 13% | Sodium carbonate |
| 5% | Antarox LF 330 |

The surfactant portion of the chemical composition used to clean oily cold rolled steel was formulated as follows:

| | |
|---|---|
| 35% | Igepal C0630 |
| 10% | Antarox LF 344 |
| 5% | Igepal CA 630 |
| 60% | Water |

After the cleaning, an additional surfactant having an HLB ratio of 4 or less was introduced into the water bath:

| | |
|---|---|
| 30% | Pluronic L61 |
| 15% | Siponic 260 |

-continued

| | |
|---|---|
| 55% | Water |

The monitor test was done by pipetting a 5 milliliter aliquot into a 100 milliliter glass stoppered graduated cylinder. Twenty (20) milliliters of methylene chloride was then added as an extracting reagent and mixed vigorously for 30 seconds, with intermittent release of the pressure buildup. The sample was then allowed to sit for 2 to 3 minutes while the layers separated in the cylinder. Fifteen (15) milliliters was then pipetted from the bottom layer into another 100 milliliter glass stoppered graduated cylinder. Five (5) milliliters of cobalt thiocyanate was added and mixed in the same manner as the first step. A sufficient amount of the bottom layer was pipetted into a Lumetron sample tube. A light absorbance test was performed on this sample at 650 nanometers. A comparison between the actual surfactant concentration and that of the optimum percentage was made. The amount of surfactant to be added was then determined.

The metal surface cleaned by this process was 100 percent clean. The surface was scanned with an infra-red spectrophotometer to look for traces of oil or other residue. Known oils have previously been run to get "fingerprint" scans to compare them with current samples. The coatings which had been removed included oil, smut, and residue.

EXAMPLE II

As in Example I, the alkaline powder cleaner and the first cleaning surfactant were the same. The additional surfactant which was introduced into the bath was formulated as follows:

| | |
|---|---|
| 25% | Siponic 260 |
| 10% | Pluronic L61 |
| 10% | Antarox LF344 |
| 55% | Water |

The monitor test and the addition of residue removing surfactant were performed in an identical manner as that of Example I.

EXAMPLE III

An alkaline powder cleaner was formulated as follows:

| | |
|---|---|
| 30% | Sodium tripolyphosphate |
| 30% | Sodium hydroxide |
| 30% | Soda ash |
| 2% | Sodium gluconate |
| 4% | Antarox LF 330 |
| 2% | Biosoft S 100 |
| 2% | Colloids 677 |

The surfactants added to this alkaline powder cleaner are identical to those in Example I.

EXAMPLE IV

An alkaline powder cleaner was formulated as in Example I, with the residue removing surfactant formulated as follows:

| | |
|---|---|
| 33% | Igepal CO 630 |
| 15% | Igepal CA 630 |

-continued

| | |
|---|---|
| 15% | N—vinyl pyrrlidone |
| 37% | Water |

The oil complexing surfactant introduced into the bath was formulated as follows:

| | |
|---|---|
| 15% | Siponic 260 |
| 85% | Water |

EXAMPLE V

An alkaline powder cleaner was formulated as follows:

| | |
|---|---|
| 35% | Sodium silicate |
| 20% | Sodium tripolyphosphate |
| 2% | Sodium gluconate |
| 3% | Antarox LF 330 |
| 10% | Tetrapyrophosphate |
| 30% | Soda ash |

The residue removing surfactants added to this alkaline powder cleaner are identical to those in Example I. The oil complexing surfactant was formulated as follows:

| | |
|---|---|
| 30% | Siponic 260 |
| 10% | Pluronic L61 |
| 60% | Water |

The cleaning results of Examples II–V demonstrated 100 percent cleanliness. These results were obtained by scanning the metal surface with an infra-red spectrophotometer as in Example I.

While the best mode for carrying out the invention has been described in detail, those familiar with the art to which this invention relates will recognize various alternative ways of practicing the invention as defined by the following claims.

What is claimed is:

1. A method for cleaning metal comprising:

applying to the metal a bath liquid having an optimal cleaning concentration including (a) at least one surfactant that removes residue on the metal and (b) at least one alkaline salt that chemically reacts with the metal to remove any coating on the metal;

periodically monitoring the concentration of surfactant in the bath liquid by performing a light absorbance test; and adding additional surfactant to the bath liquid as needed to adjust the surfactant concentration thereof to the optimal cleaning concentration while maintaining the concentration of the alkaline salt constant to thereby provide effective removal of the residue.

2. A method as in claim 1, wherein said periodic monitoring by the light absorbance test is performed by removing an aliquot of the bath liquid, placing in a separate container and adding an extracting reagent to the aliquot by mixing vigorously to form a layer of surfactant separate from the rest of the aliquot, removing a portion of the surfactant layer, sensitizing the removed surfactant layer by adding a sensitizing solution, and thereafter testing the surfactant layer by light absorbance to determine the surfactant concentration.

3. A method as in claim 2, wherein the extracting reagent comprises at least one chlorinated solvent that separates the surfactant from the rest of the aliquot.

4. A method as in claim 3, wherein the chlorinated solvent comprises methylene chloride that functions as the extracting reagent for separating the surfactant from the rest of the aliquot.

5. A method as in claim 2, wherein the sensitizing solution added includes cobalt thiocyanate which is added to the surfactant layer to provide sensitivity thereof to the light absorbance test, whereby the surfactant concentration can be more accurately determined.

6. A method as in claim 2 or 5, wherein the light absorbance testing of the surfactant is performed in the range from about 500 to about 900 nanometers.

7. A method as in claim 6, wherein the light absorbance test is performed at about 650 nanometers.

8. A method as in claim 1, wherein the adjusted surfactant concentration has an optimal cleaning concentration from about 0.01 to about 0.5 percentage by weight.

9. A method as in claim 1, wherein the alkaline salt concentration is from about 0.1 to about 5 percentage by weight.

10. A method as in claim 1, wherein at least one surfactant additive is also introduced into the bath liquid to complex with residue which has been cleaned off the metal, and wherein the initial residue removing surfactant has an HLB ratio of about 4 or more greater than the HLB ratio of the surfactant additive whereby said surfactant additive and residue form a complex compound having a density less than that of the bath liquid so as to float to the surface of the bath liquid.

11. A method as in claim 10, further comprising skimming the complex compound of residue and surfactant additive from the surface of the bath liquid.

12. A method as in claim 10, wherein a non-ionic surfactant comprises the surfactant additive that complexes with the residue.

13. A method for cleaning metal comprising:

(A) applying to the metal a bath liquid including at least one surfactant that removes residue on the metal;

(B) periodically monitoring the concentration of surfactant in the bath liquid by:

(a) removing an aliquot of the bath liquid, (b) adding an extracting reagent to the aliquot to form a layer of surfactant separate from the rest of the aliquot by mixing vigorously, (c) removing a portion of the surfactant layer, (d) sensitizing the removed surfactant layer by adding a sensitizing solution, and (e) testing the surfactant layer of the aliquot by a light absorbance test to determine the surfactant concentration; and (C) adding additional surfactant to the bath liquid to adjust the surfactant concentration.

14. A method as in claim 13, wherein the extracting reagent comprises at least one chlorinated solvent that separates the surfactant from the rest of the aliquot.

15. A method as in claim 14, wherein the chlorinated solvent comprises methylene chloride that functions as the extracting reagent for separating the surfactant from the rest of the aliquot.

16. A method as in claim 13, wherein the sensitizing solution added includes cobalt thiocyanate which is added to the surfactant layer to provide sensitivity thereof to the light absorbance test, whereby the surfactant concentration can be more accurately determined.

17. A method as in claim 16, wherein the light absorbance test is performed in the range from about 500 to about 900 nanometers.

18. A method as in claim 17, wherein the light absorbance test is performed at about 650 nanometers.

19. A method for cleaning metal comprising:

(a) applying to the metal a bath liquid having an optimal cleaning concentration including at least one surfactant having an HLB ratio of 12 or more for removing oil residue on the metal;

(b) periodically monitoring the concentration of surfactant in the bath liquid by performing a light absorbance test;

(c) adding more of said surfactant to the bath liquid to adjust the surfactant concentration thereof to its optimal cleaning concentration; and (d) introducing at least one additional surfactant additive having an HLB ratio of 4 or less into the liquid bath to complex with oil residue which has been removed from the metal, and said surfactant additive and oil residue forming a complex compound which has a density less than that of the liquid bath so as to float to the surface of the bath liquid.

20. A method as in claim 19, wherein a non-ionic surfactant comprises the additional surfactant additive that complexes with the oil residue.

* * * * *